US007753509B2

(12) United States Patent
Chambers et al.

(10) Patent No.: US 7,753,509 B2
(45) **Date of Patent: *Jul. 13, 2010**

(54) SEGMENTED INK STICK

(75) Inventors: Richard G. Chambers, Portland, OR (US); Brent R. Jones, Sherwood, OR (US); David L. Knierim, Wilsonville, OR (US); Barry D. Reeves, Lake Oswego, OR (US); Edward F. Burress, West Linn, OR (US); Ernest I. Esplin, Sheridan, OR (US); Jasper Wong, Portland, OR (US)

(73) Assignee: Xerox Corporation, Norwalk, CT (US)

( * ) Notice: Subject to any disclaimer, the term of this patent is extended or adjusted under 35 U.S.C. 154(b) by 843 days.

This patent is subject to a terminal disclaimer.

(21) Appl. No.: 11/503,795

(22) Filed: Aug. 14, 2006

(65) Prior Publication Data

US 2008/0036836 A1 Feb. 14, 2008

(51) Int. Cl.
*B41J 2/175* (2006.01)

(52) U.S. Cl. ..... 347/88

(58) Field of Classification Search ..... 347/88, 347/99

See application file for complete search history.

(56) References Cited

U.S. PATENT DOCUMENTS

| | | | | |
|---|---|---|---|---|
| 5,442,387 | A * | 8/1995 | Loofbourow et al. | 347/88 |
| 5,455,604 | A | 10/1995 | Adams et al. | |
| 5,734,402 | A | 3/1998 | Rousseau et al. | |
| 5,805,191 | A | 9/1998 | Jones et al. | |
| 5,861,903 | A | 1/1999 | Crawford et al. | |
| 6,561,636 | B1 * | 5/2003 | Jones | 347/88 |
| 6,672,716 | B2 * | 1/2004 | Jones | 347/88 |
| 6,709,094 | B2 | 3/2004 | Jones | |
| 6,755,517 | B2 | 6/2004 | Jones et al. | |
| 7,503,648 | B2 * | 3/2009 | Godil et al. | 347/88 |

* cited by examiner

*Primary Examiner*—An H Do
(74) *Attorney, Agent, or Firm*—Maginot, Moore & Beck LLP

(57) ABSTRACT

An ink stick for a phase change ink jet printer is provided. The ink stick includes a first ink stick body segment having a proximal portion and a distal portion, a second ink stick body segment having a proximal portion and a distal portion, and one or more flexible strand portions. The strand portion is formed integrally with the first ink stick body segment and the second ink stick body segment, and connects the proximal portion of the first ink stick body segment and the proximal portion of the second ink stick body segment. The strand portion flexes to permit variation in the distance between the distal portion of the first ink stick body segment and the distal portion of the second ink stick body segment.

9 Claims, 9 Drawing Sheets

SEGMENTED INK STICK

TECHNICAL FIELD

This disclosure relates generally to ink printers, the ink sticks used in such ink printers, and the devices and methods used to provide ink to such printers.

BACKGROUND

Solid ink or phase change ink printers conventionally receive ink in a solid form, as pellets or ink sticks. The solid ink pellets or ink sticks are placed in a feed chute and a feed mechanism delivers the solid ink to a heater assembly. Solid ink sticks are either gravity fed or urged by a spring through the feed chute toward a melt plate in the heater assembly. The melt plate melts the solid ink impinging on the plate into a liquid that is delivered to a print head for jetting onto a recording medium. U.S. Pat. No. 5,734,402 for a Solid Ink Feed System, issued Mar. 31, 1998 to Rousseau et al.; U.S. Pat. No. 5,861,903 for an Ink Feed System, issued Jan. 19, 1999 to Crawford et al.; and U.S. Pat. No. 6,709,094 for a Load and Feed Apparatus for Solid Ink, issued Mar. 23, 2004 to Jones describe exemplary systems for delivering solid ink sticks into a phase change ink printer. U.S. Pat. No. 4,682,185 describes a web like ink form that is formed into a roll and fed to a melt device.

A color printer typically uses four colors of ink (yellow, cyan, magenta, and black). Ink sticks of each color are delivered through corresponding feed channels to a melt plate. The operator of the printer exercises care to avoid inserting ink sticks of one color into a feed channel for a different color. Ink sticks may be so saturated with color dye that it may be difficult for a printer user to tell by color alone which color is which. Cyan, magenta, and black ink sticks in particular can be difficult to distinguish visually based on color appearance. A key plate has keyed openings to aid the printer user in ensuring that only ink sticks of the proper color are inserted into each feed channel. Each keyed opening of the key plate has a unique shape. The ink sticks of the color for that feed channel have a shape corresponding to the shape of the keyed opening. The keyed openings and corresponding ink stick shapes exclude from each ink feed channel ink, sticks of all colors except the ink sticks of the proper color for that feed channel.

Ink sticks are generally cubic in volume and formed with one or more key elements. These key elements are protuberances or indentations that are located in different positions on an ink stick. In some cases, the key elements are placed on different sides of ink sticks of different colors that are included in an ink stick set. This allows for detection and identification of the different ink sticks, particularly during loading, as noted above. For instance, corresponding keys on the perimeters of the openings through which the ink sticks are inserted into their appropriate feed channel exclude ink sticks of the set, particularly those of different colors, which do not have the appropriate perimeter key element.

An ink stick is typically pushed or slid along the feed channel by the feed mechanism until it reaches the melt plate. However, the sticky nature of an ink stick's waxy exterior surface generates friction as the ink stick is pushed along the channel. This friction may cause stick-slip movement of the ink stick and the ink stick may hang up or catch within the feed channel. The friction encountered by an ink stick increases in proportion to the number of ink sticks that are in the feed channel. Problems also arise from an ink stick being incorrectly oriented within a correct feed channel. The misorientation of such an ink stick may be difficult for an operator to detect so the troublesome stick can be removed.

Some provisions have been made to prevent the solid masses of shaped ink from sticking to the sides of the feed chutes so that an unrestricted feed of ink sticks proceeds down the channel to the heater plate for melting. For instance, the feed channel and/or the ink stick may include cooperating alignment and orientation features that facilitate alignment of the generally rectangular cross-section ink sticks in the feed channel so the possibility of jamming due to skewing of the ink stick is reduced.

The areas on a typical ink stick for keying and guiding elements are typically small. Simply increasing the size of a stick to accommodate additional features is limited because the lateral dimensions of the ink stick must not exceed the dimensions of the corresponding keyed opening or feed channel for the ink stick. While the small size allows improved resolution for topping off the ink supply when replenishing ink, an operator must supply a greater number of the ink sticks into the feed channel of the phase change ink printer, which increases the work load of the operator. As phase change ink printers have increased their printing speed, the smaller ink sticks must be replaced at an even greater rate. The key openings have been sized to accommodate the smaller sticks. Therefore, current key openings do not permit larger sticks to be inserted without changing the keyplate.

Therefore, other methods for improving the efficiency of delivering solid ink sticks along the feed channel to the melt plate would be useful.

SUMMARY

An ink stick for a phase change ink jet printer includes an ink stick body that has substantially rigid segments, each of which has a proximal portion and a distal portion. The ink stick additionally includes one or more flexible strands connecting the proximal portions of the segments to one another. The flexible strands between the first and second adjacent segments has flexibility sufficient that the strand or strands, hereafter referred to as a single strand though two or more may be used, is capable of being deformed so that the first segment is oriented in a different direction than the second segment.

An ink stick for a phase change ink jet printer includes an ink stick body formed of ink stick material, with the body compromising a flexible strand and a plurality of ink stick segments extending from the strand in a first direction. The flexible strand has a dimension in the first direction of less than approximately 6 mm.

An ink stick for a phase change ink jet printer includes a first ink stick body portion having a proximal portion and a distal portion, a second ink stick body portion also having a proximal portion and distal portion. A flexible strand portion is formed integrally with the first and second ink stick body portions, and connects the proximal ends of the first and second body portions. The flexible strand portion is capable of flexing to permit variation in the angle or distance between points of the distal portion of the first ink stick body portion and the distal portion of the second ink stick body portion.

An ink stick for use in a phase change ink jet printer, which printer has an ink feed channel for moving an ink stick in a feed direction towards an ink melter, includes an ink stick body adapted for insertion into the feed channel with a feed dimension aligned with the feed direction. The ink stick body is adapted to flex in response to force applied off axis to the feed direction.

A method of inserting an ink stick into an ink feed system includes inserting a first segment of the ink stick in a generally insertion direction into an ink stick feed channel, and bending the ink stick so that the first segment is oriented toward a feed direction, different from the insertion direction, and a second segment of the ink stick remains oriented more toward an insertion direction.

DETAILED DESCRIPTION

Figure 1:
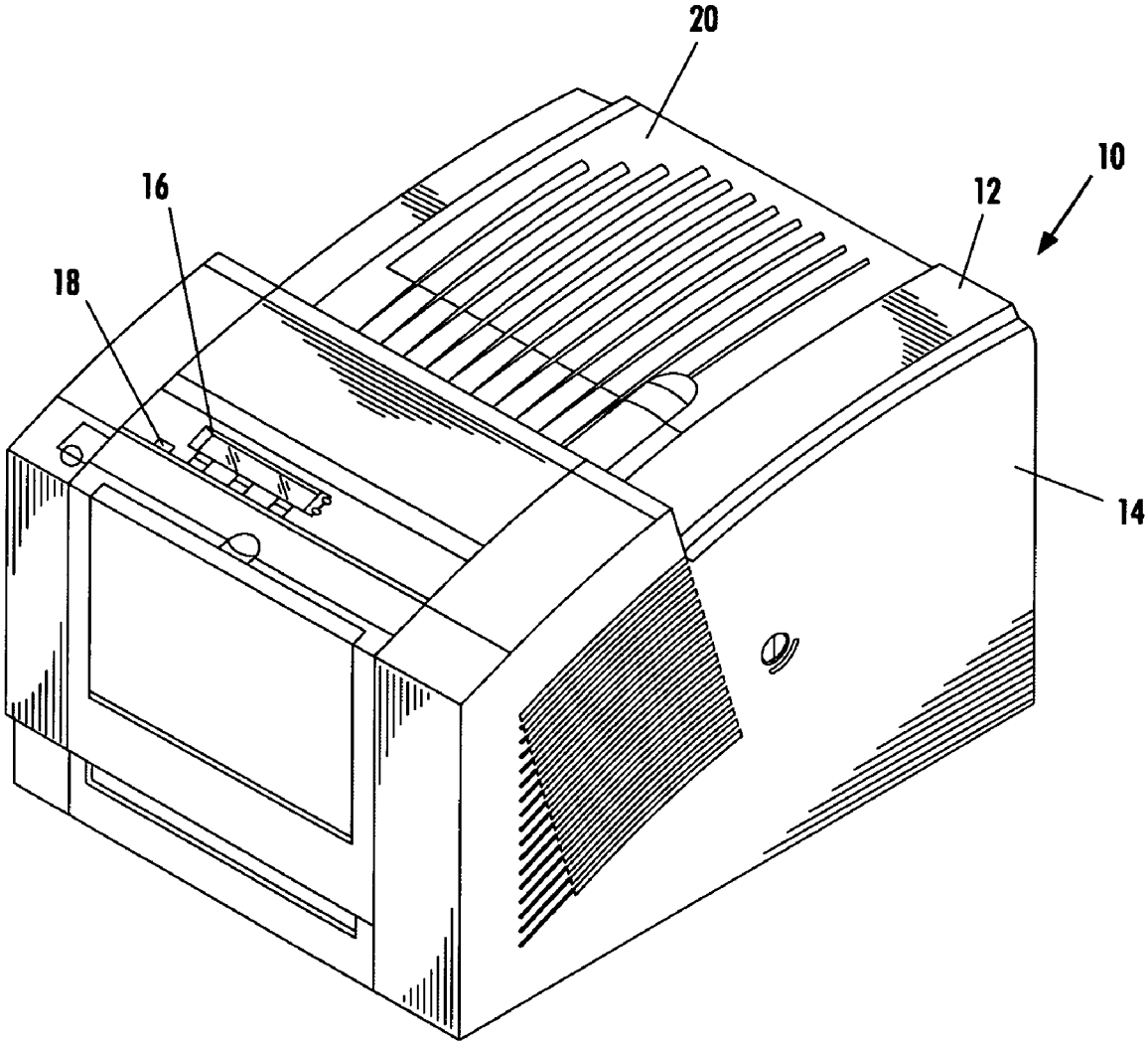
FIG. 1 is a perspective view of a phase change printer with the printer top cover closed.
Figure 2:
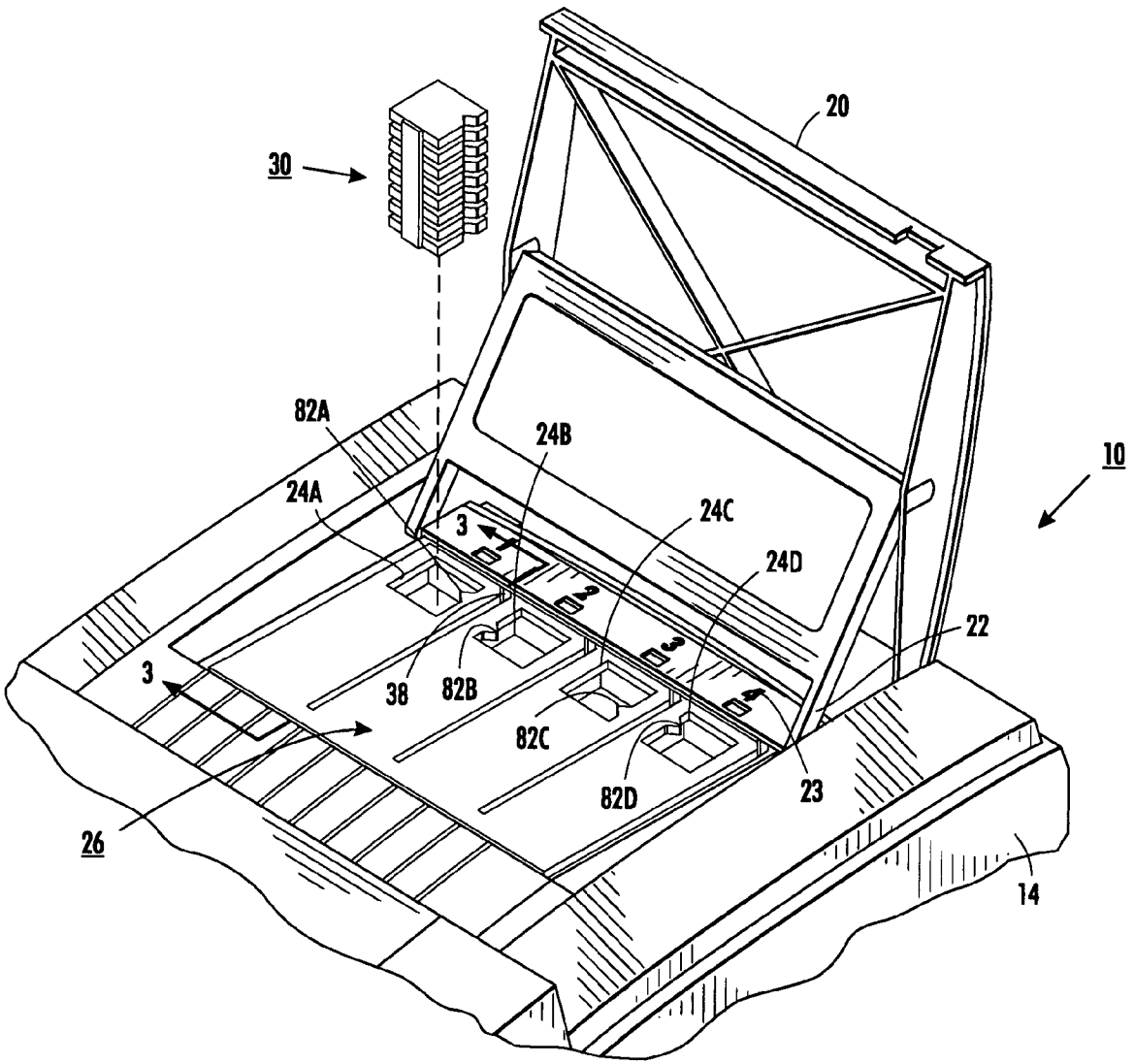
FIG. 2 is an enlarged partial top perspective view of the phase change printer with the ink access cover open, showing a solid ink stick in position to be loaded into a feed channel.

FIG. 1 shows a solid ink, or phase change, ink printer 10 that includes an outer housing having a top surface 12 and side surfaces 14. A user interface display, such as a front panel display screen 16, displays information concerning the status of the printer, and user instructions. Buttons 18 or other control elements for controlling operation of the printer are adjacent the user interface window, or may be at other locations on the printer. An ink jet printing mechanism (not shown) is contained inside the housing. Such a printing mechanism is described in U.S. Pat. No. 5,805,191, entitled Intermediate Transfer Surface Application System, to Jones et al, and U.S. Pat. No. 5,455,604, entitled Ink Jet Printer Architecture and Method, to Adams et al. An ink feed system delivers ink to the printing mechanism. The ink feed system is contained under the top surface of the printer housing. The top surface of the housing includes a hinged ink access cover 20 that opens as shown in FIG. 2, to provide the user access to the ink feed system.

Figure 3:
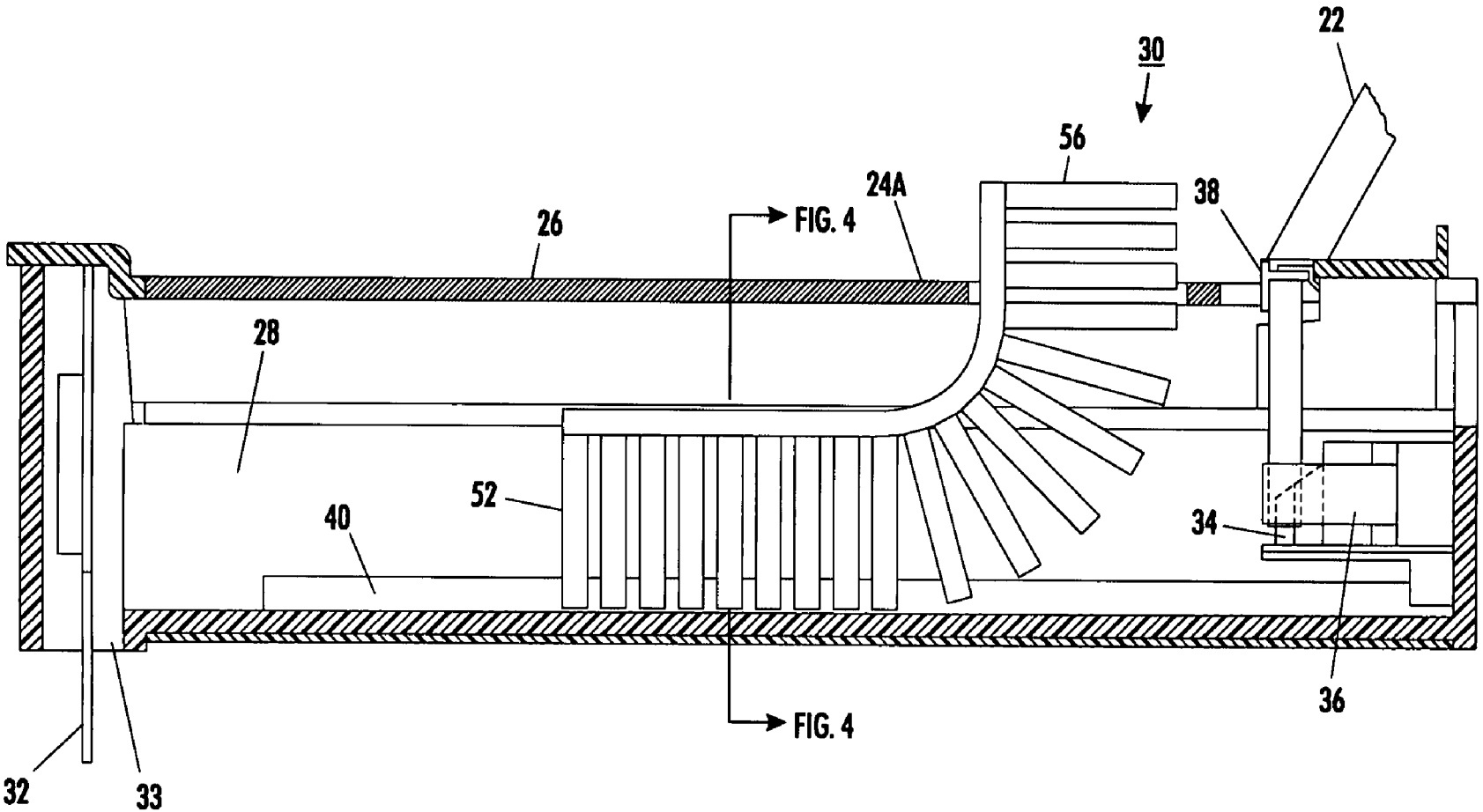
FIG. 3 is a side sectional view of a feed channel of a solid ink feed system taken along line 3-3 of FIG. 2.

In the particular printer shown, the ink access cover 20 is attached to an ink load linkage element 22 (FIG. 2) so that when the printer ink access cover 20 is raised, the ink load linkage 22 slides and pivots to an ink load position. The interaction of the ink access cover and the ink load linkage element is described in U.S. Pat. No. 5,861,903 for an Ink Feed System, issued Jan. 19, 1999 to Crawford et al., though with some differences noted below. Opening the ink access cover reveals a key plate 26 having keyed openings 24A-D. Each keyed opening 24A, 24B, 24C, 24D provides access to an insertion end of one of several individual feed channels 28 of the solid ink feed system (see FIG. 3).

Each longitudinal feed channel 28 delivers ink sticks 30 of one particular color to a corresponding melt plate 32. Each feed channel has a longitudinal feed direction from the insertion end of the feed channel to the melt end of the feed channel. The melt end of the feed channel is adjacent the melt plate. The melt plate melts the solid ink stick into a liquid form. The melted ink drips through a gap 33 between the melt end of the feed channel and the melt plate, and into a liquid ink reservoir (not shown). The feed channels 28 have a longitudinal dimension from the insertion end to the melt end, and a lateral dimension, substantially perpendicular to the longitudinal dimension. Each feed channel in the particular embodiment illustrated includes a push block 34 driven by a driving force or element, such as a constant force spring 36, to push the individual ink sticks along the length of the longitudinal feed channel toward the melt plates 32 that are at the melt end of each feed channel. The tension of the constant force spring 36 drives the push block toward the melt end of the feed channel. As described in U.S. Pat. No. 5,861,903, the ink load linkage 22 is coupled to a yoke 38, which is attached to the constant force spring 36 mounted in the push block 34. The attachment to the ink load linkage 22 pulls the push block 34 toward the insertion end of the feed channel when the ink access cover is raised to reveal the key plate 26.

A color printer typically uses four colors of ink (yellow, cyan, magenta, and black). Ink sticks 30 of each color are delivered through a corresponding individual one of the feed channels 28. The operator of the printer exercises care to avoid inserting ink sticks of one color into a feed channel for a different color. Ink sticks may be so saturated with color dye that it may be difficult for a printer user to tell by color alone which color is which. Cyan, magenta, and black ink sticks in particular can be difficult to distinguish visually based on color appearance. The key plate 26 has keyed openings 24A, 24B, 24C, 24D to aid the printer user in ensuring that only ink sticks of the proper color are inserted into each feed channel. Each keyed opening 24A, 24B, 24C, 24D of the key plate has a unique shape. The ink sticks 30 of the color for that feed channel have a shape corresponding to the shape of the keyed opening. The keyed openings and corresponding ink stick shapes exclude from each ink feed channel ink sticks of all colors except the ink sticks of the proper color for that feed channel.

Figure 4:
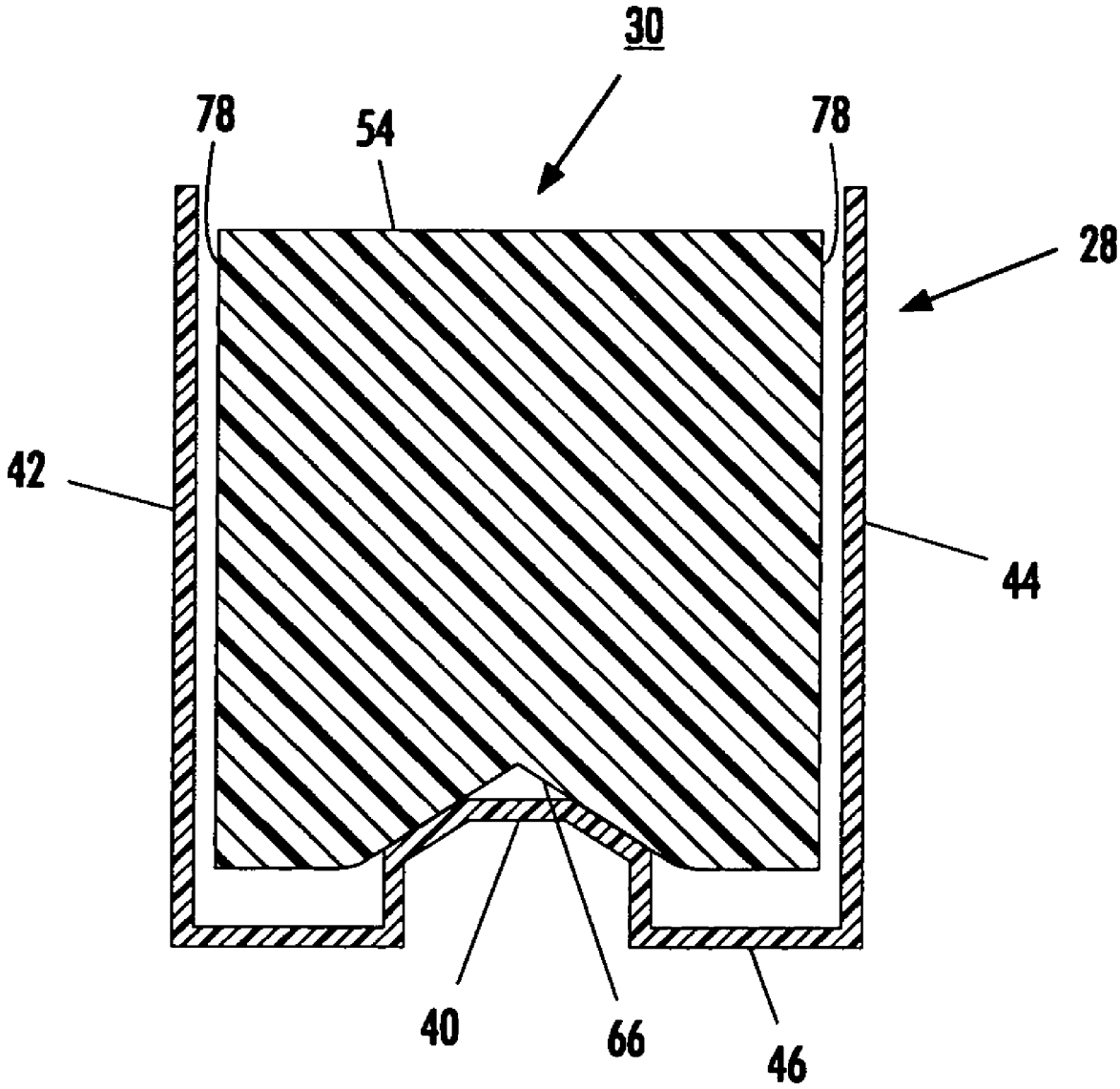
FIG. 4 is a simplified cross-sectional view of a feed channel taken along line 4-4 of FIG. 3.

Referring next to FIG. 4, the feed channel 28 is defined by lateral side walls 42, 44 that may be substantially vertical, and a bottom 46. The transverse dimension is between the lateral side walls 42, 44. A longitudinal feed channel guide rail 40 is included in a lower portion of the feed channel, preferably near the bottom of the feed channel. This feed channel guide rail 40 is aligned with the central longitudinal axis of the feed channel. The guide rail 40 is designed to receive the guide portions of an ink stick. The exemplary feed channel guide rail illustrated is approximately the shape of an inverted "V" with a truncated peak, so that the width of the feed channel guide rail 40 at its peak is substantially less than the width of the feed channel between the side walls 42, 44.

Figure 5:
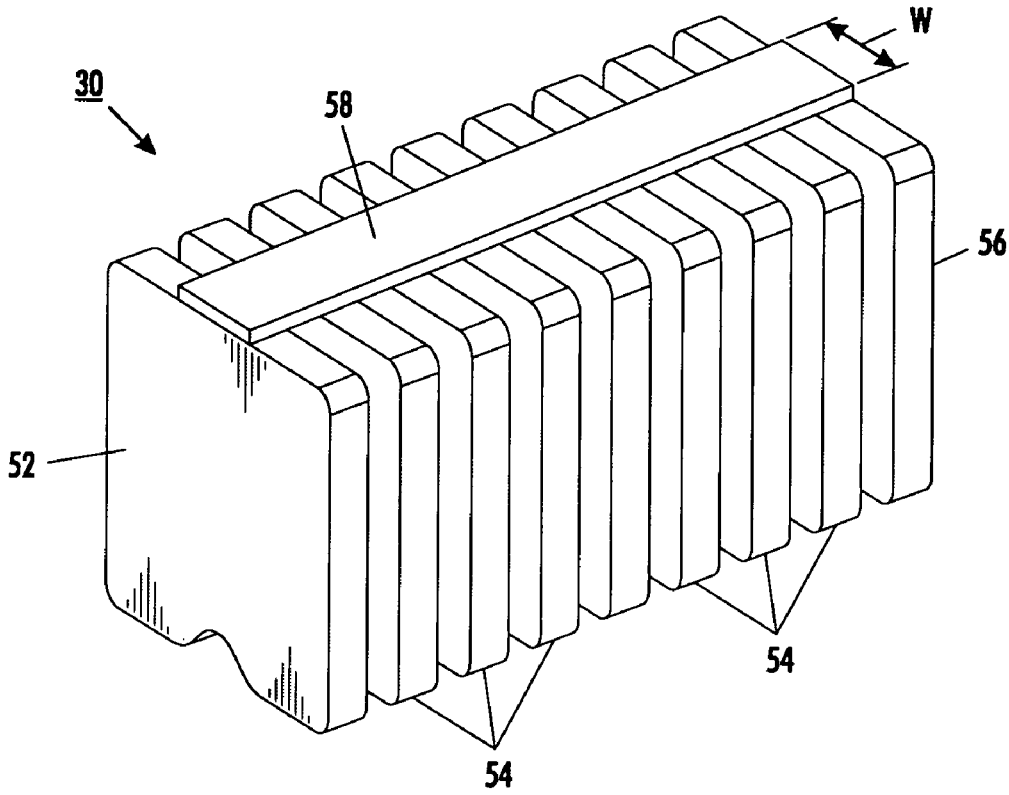
FIG. 5 is a perspective view of a segment of one embodiment of a solid ink stick.
Figure 6:
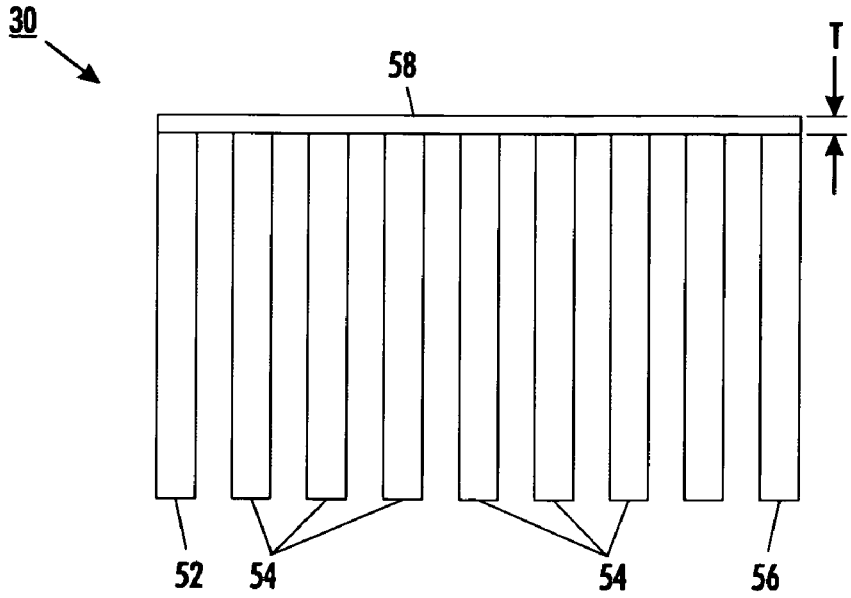
FIG. 6 is a side elevational view of the ink stick of FIG. 5.

An exemplary solid ink stick 30 for use in the feed channel with the feed channel guide rail comprises a segmented or flexible ink stick as shown in FIGS. 5 and 6. The ink stick is formed of a three dimensional ink stick body having a plurality of teeth 54, or segments, and one or more flexible strands 58 connecting the segments to one another. The flexible strand may be external or internal to the general body of the ink stick segments. The ink stick is illustrated without the keying features that correspond to the key plate openings 24A-D through the key plate 26, to simplify the illustration.

Figure 7:
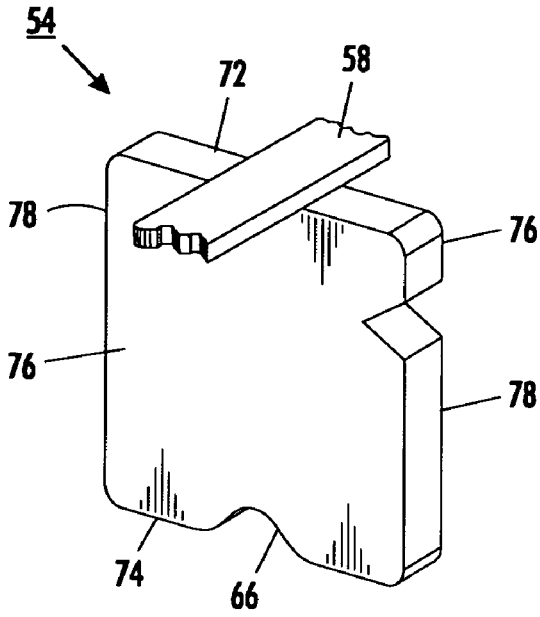
FIG. 7 is a perspective view of a segment of the flexible ink stick of FIG. 5.

Referring to FIG. 7, each segment 54 of the ink stick 30 is similarly shaped and comprises a proximal portion 72, a distal portion 74, a pair of longitudinal surfaces 76 and a pair of lateral sides 78. The outermost lateral dimension of each segment 54 from lateral side 78 to lateral side 78 is only fractionally smaller than the lateral dimension of the ink stick feed channel 28. Each segment 54 has a vertical dimension from proximal portion 72 to distal portion 74 (not including protruding insertion key or orientation elements) of between approximately 1.0 and 1.5 inches (25-38 mm), such as 1.25 inches (32 mm). The lateral dimension of the ink stick feed channel 28 between the side walls 42, 44 may be approximately 0.004 to 0.08 inches (0.1-2.0 mm) wider than the width of the lateral dimension of the ink stick body. Each segment has a width between longitudinal surfaces 76 that may be 0.2 to 0.75 inches (5.0 to 19 mm).

Referring again to FIGS. 5-6, a flexible strand 58 connects the proximal portions 72 of the separate ink stick segments 54 to one another in a relatively evenly spaced apart manner along the connecting strand 58 so that each segment 54 of the ink stick 30 is substantially parallel with each other, except drafting angles, keying or other features and substantially perpendicular to the connecting flexible strand 58. The first end segment 52 comprises a first longitudinal end and a second end segment 56 comprises a second longitudinal end.

Figure 8:
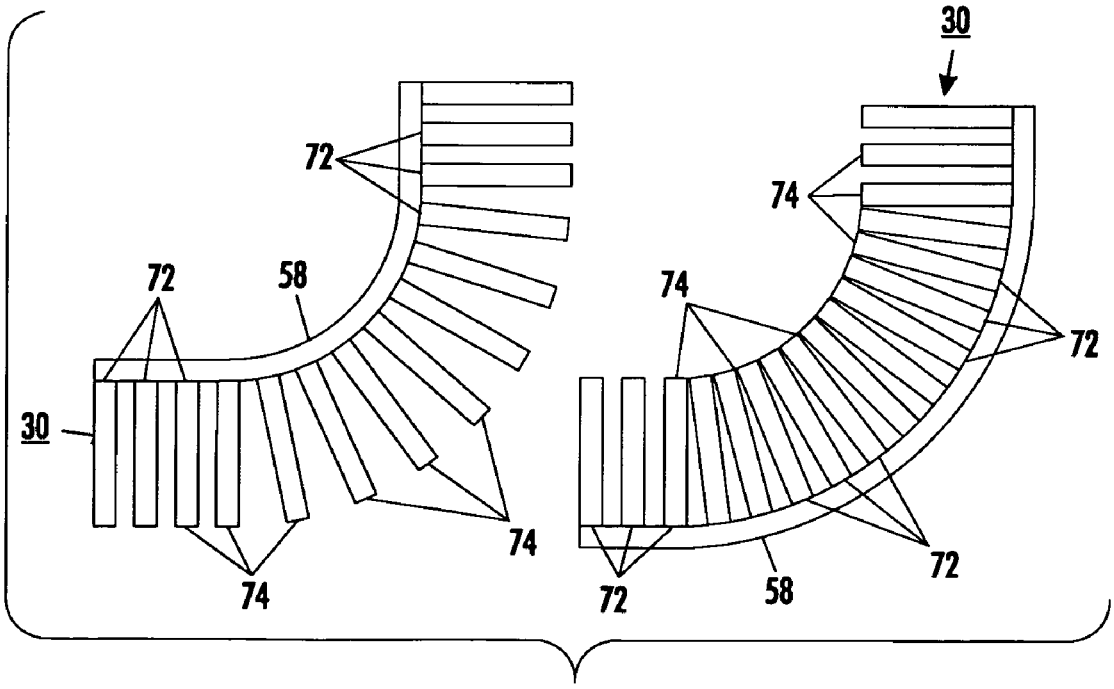
FIG. 8 is a side perspective view of the flexibility of the segmented ink stick of FIG. 5.
Figure 13:
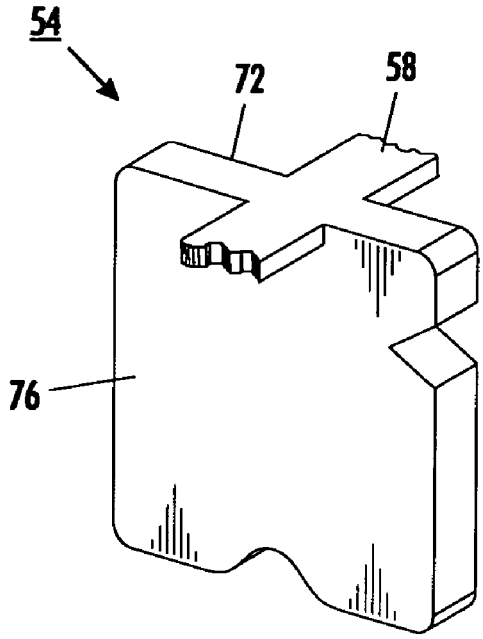
FIG. 13 is a perspective view of a segment of another embodiment of a solid ink stick.

The flexible strand 58 connecting the segments 54 is thin vertically relative to the height of each segment 54 of the ink stick 30 from the proximal portion 72 to the distal portion 74, and has a vertical dimension T that is approximately less than about 1-6 mm (0.04-0.25 in), and particularly may be less than 4 mm (0.15 in). The small size of the flexible strand 58 allows the strand to be sufficiently flexible so as to allow the flexible strand portion 58 between each segment of the ink stick to be bent. The width W of the flexible strand 58 may also be thin relative to the width of the ink stick segment 54 between the lateral sides 78, or the strand may extend across the entire width of the ink stick segments. The flexible strand 58 may be formed to appear superimposed on top of the proximal portion 72 of the ink stick (as shown). In alternatives, the flexible strand 58 may be formed between the ink stick segments so that the strand does not project above the general surface of the proximal portion 72 of the ink stick. An example of such an ink stick is shown in FIG. 13. As shown in FIG. 8, when the strand portion between successive segments is flexed or bent, points of the distal portion 74 of the segments are moved closer together or farther apart than the proximal portion 72 of the segments.

Figure 14:
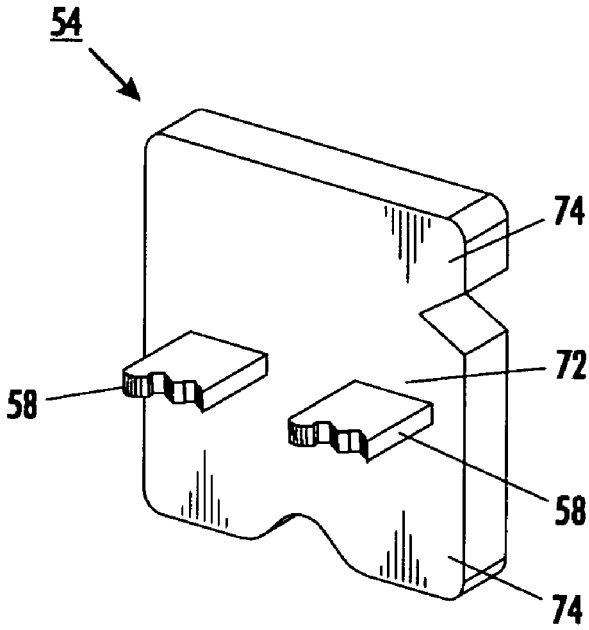
FIG. 14 is a perspective view of a segment of yet another embodiment of a solid ink stick.

In yet other configurations, the flexible strand 58 may be connected at points other than the edges of the ink stick segments 54, so that the proximal portion 72 of the ink stick segment is away from the ends of the ink stick segment. It is possible in some such configurations to have multiple distal portions 74 of the ink stick segment It is possible in some such configurations to have multiple distal portions 74 of the ink stick segment. FIG. 14 shows a configuration in which two flexible strands 58 connect centrally located proximal portions of adjacent ink stick segments 54.

Referring again to FIGS. 3-4, the ink stick 30 is configured to fit into the feed channel 28 with the longitudinal axis of the ink stick oriented along the longitudinal feed direction of the feed channel and the lateral sides 78 of each segment 54 of the ink stick body oriented along the transverse or lateral dimension of the feed channel. One of the longitudinal ends 52 is a front or leading end, and the other longitudinal end 56 is a rear or trailing end though the ends may not be configured differently nor be required to be inserted or fed in a particular end-end orientation other than as determined by keying features that may be present.

When inserting a keyed ink stick in an insertion direction into the feed channel, the ink stick is oriented so that the key element corresponding to the complementary key of the keyed opening is inserted first. The connecting flexible strand of the ink stick could be oriented so that it will be situated on the top or bottom while the ink stick is in the feed channel. This allows the ink stick to be flexed or bent transverse to the feed direction so that the leading end of the ink stick is longitudinally fed into the feed channel. A strand position at the side or sides would also permit the appropriate flexure if the cross section shape of the strand or strands were configured for flex in the appropriate direction relative to insertion requirements. Each successive segment of the ink stick is then inserted into the keyed opening, bent and then fed into the channel. The flexibility of the ink stick allows it to enter the feed channel in an insertion direction, bend through the insertion opening and then straighten out for feeding in a feed direction in the feed channel, with the insertion and feed directions having different orientations. These ink sticks could provide a user with a specific and consistent volume of ink for use in a printer.

The flexible strand could be placed in the central area of the ink stick segments, could be at the sides or bottom or could be in line at two or more places across the general width of the stick at any elevation in relation to the top or bottom of the ink stick. The flexible strand need not be rib like or rectangle as long as the resulting ink stick possessed the intended flexure properties. The flexible strand could have any of several cross-sectional shapes, including round or oval. A more general shape is described for easy visualization but any configuration that provides the described flexibility is intended to be within the scope of the invention. Likewise, the number of ink stick body segments could be many but could also be as few as two.

The ink stick body 30 may be integrally formed, including the segments 54 and the connecting strands 58, of an ink stick material by pour molding, compression molding, or other formation techniques. In implementations, the ink stick segments 54 and flexible strand 58 may be molded together. In other implementations, the ink stick segments 54 may be molded, with the flexible strand 58 molded on or affixed separately. In yet further implementations, the flexible strand 58 may formed of a material different from the material of the ink stick segments 54. For example, the flexible strand 58 may be molded of an ink material having a constituency to give it greater flexibility than the material of the ink stick segments 54. Or, the flexible strand 58 may be formed of a foreign material, such as a flexible plastic. Such a plastic strand can be provided with an adhesive backing or interlocking configuration to couple with the ink stick segments. The user could then remove the connecting flexible strand as the ink stick is inserted into the feed channel, or the printer ink delivery system may be configured to separate the strand from the ink segments in the feed channel, upstream of the melt plate 32. An exemplary strand removal means might include a knife block for cutting the strand from the ink stick segment. Another exemplary strand removal means might include a separator such as a wedge that urges the strand away from the melt gap 33 as the ink stick segments are melted away from underneath the strand.

The ink stick body, including the segments 54 and the connecting strand 58, may have a longitudinal dimension of any desired length. In the embodiment shown, the longitudinal dimension between the longitudinal ends 52, 56 is less than the longitudinal dimension of the feed channel 28 and may be (not including protruding insertion key or orientation elements) between approximately ½ and 8 inches (12-200 mm), such as 3 inches (75 mm).

The maximum thickness of the flexible strand 58 that still allows sufficient flexibility is determined by the suppleness of the material of which the strand is formed. If the strand 58 is formed of the same solid ink material of which the ink stick segments 54 are formed, empirical evidence indicates that different ink materials have different amounts of suppleness. Therefore, the maximum thickness of the flexible strand 58 depends on the ink material of which the strand is formed. Empirical testing of each particular material may be required to determine its suppleness. Persons skilled in the art recognize that numerous factors affect the suppleness of the ink material, including chemical constituencies and formulation, and aspects of the manufacturing processes.

In another embodiment of the segmented ink stick, the connecting strand may be configured to fracture so that the ink stick can be controllably separated at various locations such as between the ink stick segments 54. This feature may facilitate a clean break of the ink stick so that a desired longitudinal length may be achieved providing greater flexibility for tooling and usability when sectioning the ink stick to specific lengths.

Figure 9:
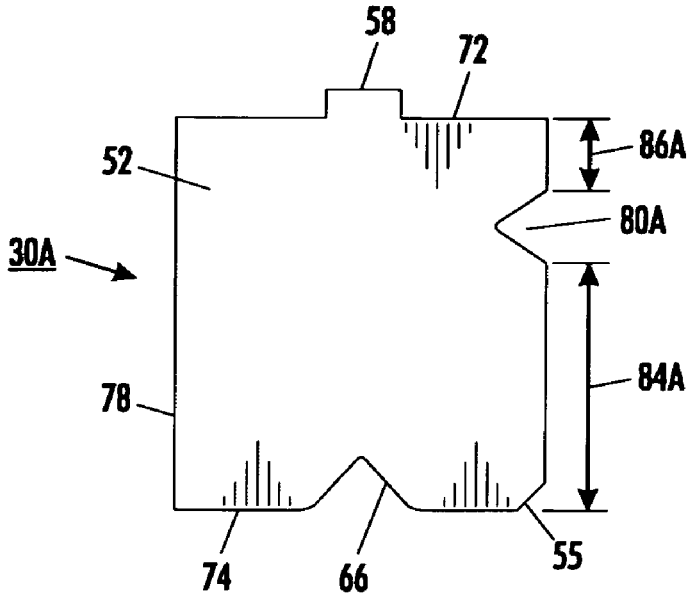
FIG. 9 is an end elevational view of the ink stick of FIG. 5.

Referring to FIG. 9, each segment of the ink sticks shown in FIGS. 4 and 5 has a cross-sectional shape corresponding to the shape of the keyed opening 24A-D of the corresponding feed channel for that particular color. The ink stick body may include a key element 80 of a particular predetermined size, shape, and location on the outer perimeter of each segment of the ink stick body. In the particular examples illustrated, the ink stick key element 80 is formed in the longitudinal perimeter segment formed by the outermost portion of the lateral side surface. For an ink stick of a particular color, the ink stick key element 80 matches a complementary key 82A, 82B, 82C, 82D formed in the perimeter of the keyed openings 24A, 24B, 24C, 24D in the key plate. Each color for a printer has a unique arrangement of one or more key elements in the outer perimeter of each segment of the ink stick to form a unique cross-sectional shape for that particular color ink stick. The combination of the keyed openings 24A, 24B, 24C, 24D in the key plate 26 and the keyed shapes of the ink sticks 30 (formed by the key elements 80) ensure that only ink sticks of the proper color are inserted into each feed channel. A set of ink sticks is formed of an ink stick of each color, with a unique key arrangement for ink sticks of each color.

In the ink stick embodiment shown in FIG. 9, the key element 80 is a vertical recess or notch formed in one of the lateral sides 78 of each segment of the ink stick body. The corresponding complementary key 82A, 82B, 82C, 82D on the perimeter of the keyed opening 24A-D is a complementary protrusion into the opening. An inwardly directed key element, such as a notch, in the ink stick body provides improved ability to exclude incorrect ink sticks. Only an ink stick with a recess of that particular location, shape, and size (or larger) will fit through the keyed opening in the key plate having a key consisting of a corresponding protrusion from the edge of the keyed opening. In addition, a recessed key element on the ink stick body allows much of the lateral side surfaces 56 of the ink stick body to be substantially flat. The key element might protrude or be inset by any reasonable amount, but typically extends approximately 0.16 inch (4 mm) into the ink stick body.

Figure 10:
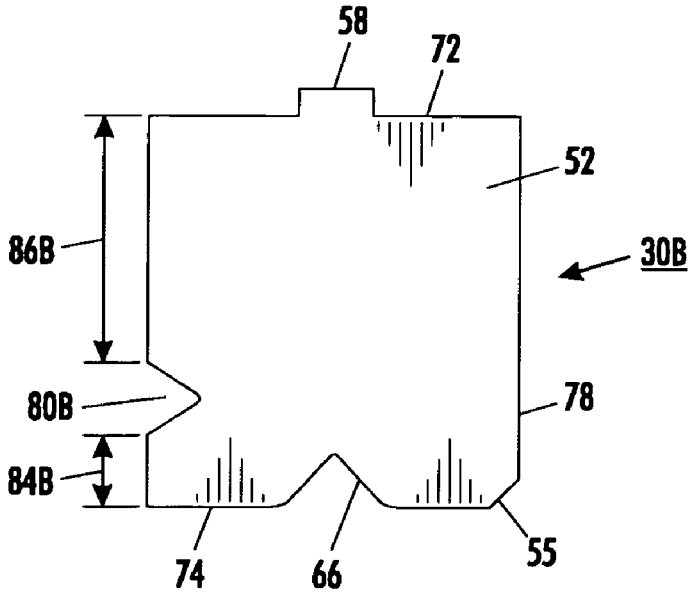
FIG. 10 is an end elevational view of another solid ink stick.
Figure 11:
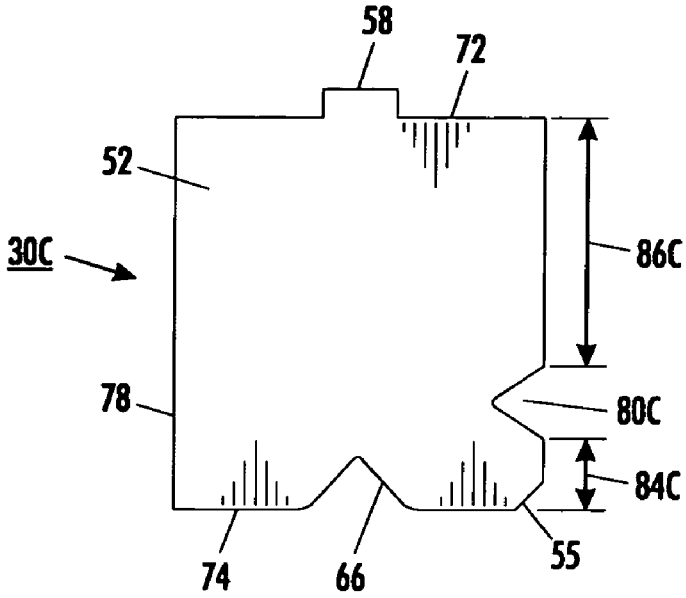
FIG. 11 is an end elevational view of another solid ink stick.
Figure 12:
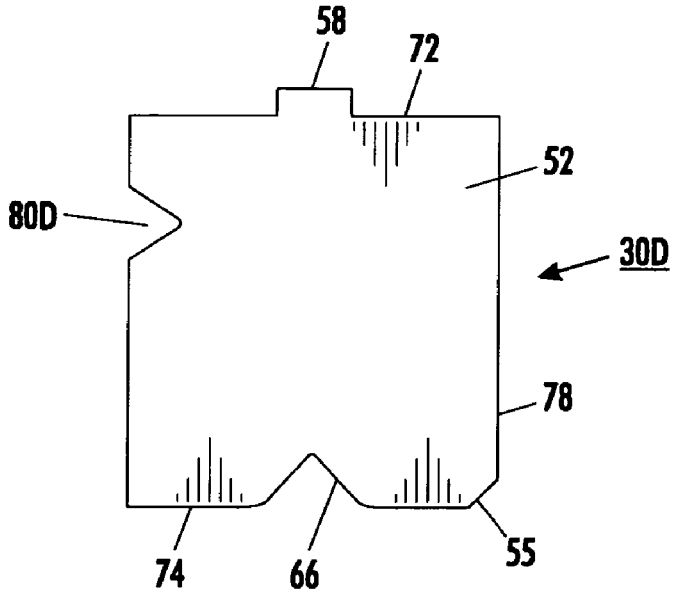
FIG. 12 is an end elevational view of another solid ink stick.

FIG. 9 is an end view of the ink stick of FIG. 5. FIGS. 10, 11, and 12 are end views of ink sticks that may be included in a multi-color set of ink sticks for use in the printer shown in FIGS. 1-3. As can be seen by comparing ink stick shapes of FIGS. 10, 11, and 12 with the keyed openings 24A-D of the key plate visible in FIG. 2, a set of ink sticks provides a unique one-to-one match between a particular color ink stick and the keyed openings providing access to the four ink stick feed channels 28. Such one-to-one match is provided by including a key element 80 of a single predetermined size and shape at different locations around the outer perimeter of the ink stick body. For example, an ink stick with the key element 80A positioned as shown in FIG. 9 can be inserted into the first keyed opening 24A in the key plate shown in FIG. 2, but cannot be inserted into any of the other keyed openings 24B, 24C, 24D. The keys 82B, 82C, 82D in the keyed openings 24B, 24C, 24D of the key plate and corresponding to the key element positions shown in the ink sticks 30B, 30C, 30D of FIGS. 10, 11, and 12 will block the ink stick 30A of FIG. 9. The ink stick 30B having the key element 70B positioned as shown in FIG. 10 can be inserted into the second keyed opening 24B of the key plate shown in FIG. 2, but not into the other keyed openings 24A, 24C, 24D. The ink sticks having the key elements 80C, 80D positioned as shown in FIGS. 11 and 12 (respectively) can be inserted into and only into the third and fourth key openings 24C, 24D, which correspond to the third and fourth ink stick feed channels. Thus, the key elements 80A, 80B, 80C, 80D provide discrimination among the different feed channels to stop the user from inserting an ink stick into the incorrect ink stick feed channel.

The illustrated key elements 80A, 80B, 80C, 80D are of substantially the same size and shape as one another, but are in different positions around the perimeter of the ink stick body. The key element 80C in the third ink stick 30C is formed in the same lateral side surface 78 as the key element 80A in the first ink stick 30A. But, the leading distance 84C from the distal end 74 to the key element 80C of the third ink stick 30C is smaller than the distal distance 84A from distal end 74 to the key element 80C of the first ink stick 30A. More than one key element 80 can be included on a side surface 78 of the ink stick body. In particular, at least some of the key elements are on different sides of the ink stick horizontal perimeter. Thus, the key element 80A of the first ink stick is on a first section of the perimeter, while the key element 80B of the second ink stick is on a second section of the perimeter. The first and second sections of the perimeter do not correspond or align with one another when the first and second ink sticks 30A, 30B are aligned with one another.

An orientation feature 55 in each ink stick is useful to prevent erroneous ink insertion when the key element patterns (size and position) are symmetrical. The orientation feature illustrated is a corner notch in each ink stick. Referring to FIGS. 9 and 10, the orientation feature prohibits incorrect insertion of the first ink stick 30A into the second keyed opening 24B if the distal distance 84A and proximal distance 86A of the first ink stick 30A are the same as the proximal distance 86B and distal distance 84B of the second ink stick 30B. Those skilled in the art will identify numerous other types and configurations of features to ensure that ink sticks are inserted into the key opening with the correct orientation. For example, the orientation feature can be provided by positioning the key elements 80 so that the distal and proximal distances on different ones of the ink sticks are not symmetrical. Referring to the ink sticks shown in FIGS. 9 and 10, the orientation feature can be provided by having the distal distance 84A of the first ink stick 30A a different length than the proximal distance 86B of the second ink stick 30B and the proximal distance 86A of the first ink stick 30A a different length than the distal distance 84B of the second ink stick 30B.

In an alternative, the orientation feature can be provided by a nesting feature in which a protruding element from the leading end surface 52 of one ink stick nests with a recessed element in the trailing end surface 56 of an adjacent ink stick, as described in U.S. Pat. No. 6,755,517, entitled Alignment Feature for Solid Ink Stick, by Jones, et al., the contents of which are hereby incorporated by reference. Uniform or distorted rectangular or non-rectangular segment shapes, such as ovals, triangles and trapezoids, pentagons, and other shapes can also be used for aesthetics, ink stick set recognition, ink stick orientation identification and control, and/or keying.

The common shape and size of the key elements for the ink sticks of a particular set of ink sticks for a printer facilitates manufacture of the ink sticks, and enhances the "family" appearance of the set of ink sticks for that particular printer model. Different shapes and/or sizes of key elements can be used to differentiate ink sticks intended for different models of printers. For example, one printer could use triangular ink stick key elements 80. A different printer model could use semicircular ink stick key elements (not shown). Yet a different printer model could use rectangular ink stick key elements (not shown). The ink stick key elements need not all be formed in the longitudinal perimeter segments formed on the lateral side surfaces of the ink stick body. Key elements can also be formed in perimeter segments of the ink stick body that are at least partially transverse longitudinal feed direction. For example, key elements can be formed in the perimeter segments formed by the outermost portions of the end surfaces of the ink stick body.

Those skilled in the art will recognize that numerous modifications can be made to the specific implementations described above. Those skilled in the art will recognize that the guide element in the bottom surface of the ink stick body, and the guide rail in the bottom of the feed channel may have numerous shapes or locations other than the particular configurations illustrated. Strand geometry, size, placement, and quantity can vary to interact with keying and/or orientation control, encourage flexure in one axis or multiple axes, enhance aesthetics and/or handling and to visually differentiate one stick or set from another stick or set. As example, two round flexible strands could be used at either side of the series of segments, centered vertically such that flexure is allowed in one axis but discouraged in the other. In addition, numerous other configurations of the feed channel, key plate, and other components of the ink feed system can be constructed within the scope of the invention. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An ink stick for a phase change ink jet printer, the ink stick comprising:

an ink stick body having a plurality of substantially rigid segments, each of which has a proximal portion and a distal portion, and a flexible strand connecting the proximal portions of the segments to one another, the flexible strand between adjacent rigid segments has sufficient flexibility to enable the flexible strand to bend in a manner to position the distal portions of the adjacent rigid segments farther apart from one another than the proximal portions of the adjacent rigid segments.

2. An ink stick for a phase change ink jet printer, the ink stick comprising:

an ink stick body having a plurality of substantially rigid segments, each of which has a proximal portion and a distal portion, and a flexible strand connecting the proximal portions of the segments to one another, the flexible strand between adjacent rigid segments has sufficient flexibility to enable the flexible strand to bend to position the distal portions of the adjacent rigid segments closer to one another than the proximal portions of the adjacent rigid segments are.

3. An ink stick for a phase change ink jet printer, the ink stick comprising:

an ink stick body formed of ink stick material, the ink stick body comprising a flexible strand and a plurality of ink stick segments extending from the flexible strand in a first direction, the flexible strand having a dimension in the first direction of less than 6 mm.

4. The ink stick of claim 3, wherein each of the ink stick segments extends at least approximately 15 mm in the first direction from the flexible strand.

5. The ink stick of claim 4 wherein each ink stick segment has a dimension of at least approximately 6 mm in a second direction, substantially perpendicular to the first dimension.

6. An ink stick for a phase change ink jet printer, the ink stick comprising:

a first ink stick body segment having a proximal portion and a distal portion:

a second ink stick body portion having a proximal portion and a distal portion; and a flexible strand portion, the flexible strand portion being formed integrally with the first ink stick body segment and the second ink stick body segment to connect the proximal portion of the first ink stick body segment and the proximal portion of the second ink stick body segment and to enable variation in a distance between the distal portion of the first ink stick body segment and the distal portion of the second ink stick body segment.

7. The ink stick of claim 6, wherein:

the first and second ink stick body segments each have an extension dimension from the proximal portion to the distal portion;

the flexible strand portion has a flexible strand dimension in the same direction as the extension dimension of the first and second ink stick body segments; and the flexible strand dimension of the strand portion is no more than 6 mm.

8. An ink stick for use in a phase change ink jet printer, wherein the printer has an ink feed channel for moving an ink stick in a feed direction toward an ink melter, the ink stick comprising:

an ink stick body adapted for insertion into the feed channel with a feed dimension aligned with the feed direction, the ink stick body being adapted to flex in response to force applied transversely to the feed direction.

9. An ink stick for a phase change ink jet printer, the ink stick comprising:

an ink stick body having a plurality of substantially rigid segments, each of which has a proximal portion and a distal portion, and a flexible strand connecting the proximal portions of the segments to one another, the flexible strand between adjacent rigid segments has sufficient flexibility that the flexible strand is capable of being deformed in a manner to orient one rigid segment in a different direction than the other rigid segment.

* * * * *